US010530042B2

(12) United States Patent
Avser et al.

(10) Patent No.: US 10,530,042 B2
(45) Date of Patent: Jan. 7, 2020

(54) ELECTRONIC DEVICE HAVING SHARED ANTENNA STRUCTURES

(71) Applicant: Apple Inc., Cupertino, CA (US)

(72) Inventors: Bilgehan Avser, Mountain View, CA (US); Georgios Atmatzakis, Cupertino, CA (US); Hao Xu, Cupertino, CA (US); Mattia Pascolini, San Francisco, CA (US); Salih Yarga, Sunnyvale, CA (US); Xu Gao, Santa Clara, CA (US); Xu Han, Santa Clara, CA (US); Yijun Zhou, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 224 days.

(21) Appl. No.: 15/699,879

(22) Filed: Sep. 8, 2017

(65) Prior Publication Data

US 2019/0081385 A1 Mar. 14, 2019

(51) Int. Cl.

| | |
|---|---|
| ***H01Q 1/24*** | (2006.01) |
| ***H01Q 9/04*** | (2006.01) |
| ***H01Q 5/50*** | (2015.01) |
| ***H01Q 5/328*** | (2015.01) |
| ***H01Q 9/42*** | (2006.01) |
| *H01Q 1/38* | (2006.01) |

(52) U.S. Cl.

CPC ..... *H01Q 1/243* (2013.01); *H01Q 5/328* (2015.01); *H01Q 5/50* (2015.01); *H01Q 9/0421* (2013.01); *H01Q 9/42* (2013.01); *H01Q 1/38* (2013.01)

(58) Field of Classification Search

CPC ..... H01Q 1/243; H01Q 5/328; H01Q 5/50; H01Q 9/0421; H01Q 9/42

USPC ..... 343/702

See application file for complete search history.

(56) References Cited

U.S. PATENT DOCUMENTS

| | | | | |
|---|---|---|---|---|
| 7,705,791 | B2 | 4/2010 | Ollikainen | |
| 9,331,397 | B2 * | 5/2016 | Jin | H01Q 21/28 |

FOREIGN PATENT DOCUMENTS

| | | |
|---|---|---|
| EP | 3035441 | 6/2016 |
| EP | 3073571 | 9/2016 |
| WO | 2011057302 | 5/2011 |

* cited by examiner

*Primary Examiner* — Huedung X Mancuso

(74) *Attorney, Agent, or Firm* — Treyz Law Group, P.C.; Joseph F. Guihan

(57) ABSTRACT

An electronic device may be provided with wireless circuitry. The wireless circuitry may include multiple antennas and transceiver circuitry. The antennas may include antenna structures at opposing first and second ends of the electronic device. The antenna structures at a given end of the device may include antenna structures that are shared between multiple antennas. The electronic device may include a first antenna with an inverted-F antenna resonating element formed from portions of a peripheral conductive housing structure and may have an antenna ground that is separated from the antenna resonating element by a gap. A return path may bridge the gap. The electronic device may also include a second antenna that includes the antenna ground and an additional antenna resonating element. The antenna resonating element of the second antenna may be parasitically coupled to the return path of the inverted-F antenna at given frequencies.

20 Claims, 11 Drawing Sheets

ELECTRONIC DEVICE HAVING SHARED ANTENNA STRUCTURES

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It can be challenging to form electronic device antenna structures with desired attributes. In some wireless devices, antennas are bulky. In other devices, antennas are compact, but are sensitive to the position of the antennas relative to external objects. If care is not taken, antennas may become detuned, may emit wireless signals with a power that is more or less than desired, or may otherwise not perform as expected.

It would therefore be desirable to be able to provide improved wireless circuitry for electronic devices.

SUMMARY

An electronic device may be provided with wireless circuitry and control circuitry. The wireless circuitry may include multiple antennas and transceiver circuitry. The antennas may include antenna structures at opposing first and second ends of the electronic device. The antenna structures at a given end of the device may include antenna structures that are shared between multiple antennas.

The electronic device may include an antenna with an inverted-F antenna resonating element formed from portions of a peripheral conductive electronic device housing structure and may have an antenna ground that is separated from the antenna resonating element by a gap. A short circuit path (return path) may bridge the gap. An antenna feed may be coupled across the gap in parallel with the short circuit path. The inverted-F antenna resonating element may be used to convey radio-frequency signals in a first frequency band.

The electronic device may include an additional antenna that includes the antenna ground and metal traces that form an antenna resonating element arm. The additional antenna may convey radio-frequency signals in a second frequency band that is different from the first frequency band. The antenna resonating element arm of the additional antenna may be parasitically coupled to the return path of the inverted-F antenna at frequencies in a third frequency band that is different from the first and second frequency bands. A portion of the peripheral conductive electronic device housing structure, a portion of the return path for the inverted-F antenna, and a portion of the antenna resonating element arm for the additional antenna may resonate in the third frequency band.

DETAILED DESCRIPTION

Figure 1:
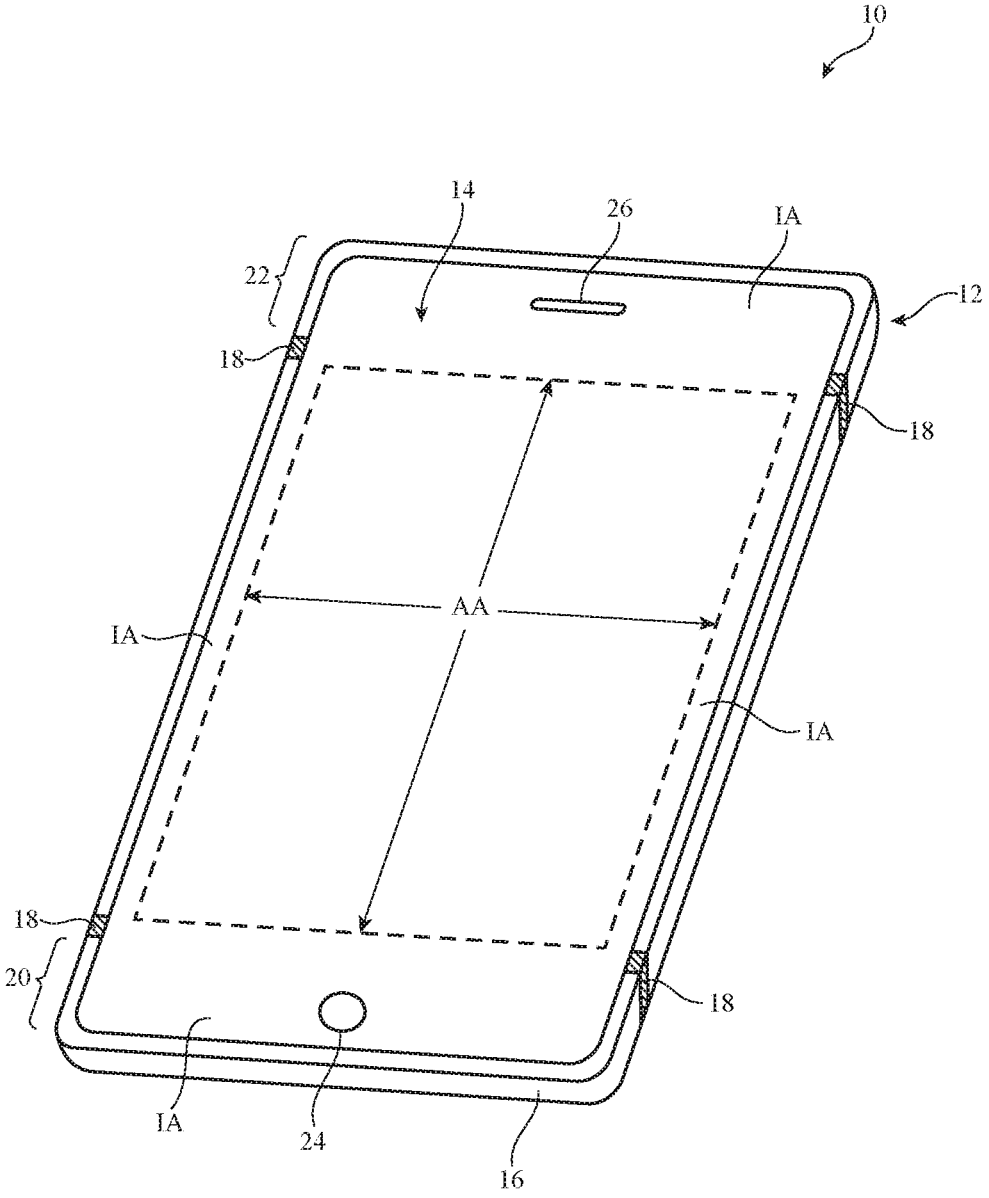
FIG. 1 is a perspective view of an illustrative electronic device in accordance with an embodiment.

Electronic devices such as electronic device 10 of FIG. 1 may be provided with wireless communications circuitry. The wireless communications circuitry may be used to support wireless communications in multiple wireless communications bands.

The wireless communications circuitry may include one more antennas. The antennas of the wireless communications circuitry can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures.

The conductive electronic device structures may include conductive housing structures. The housing structures may include peripheral structures such as peripheral conductive structures that run around the periphery of an electronic device. The peripheral conductive structures may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane and/or an antenna resonating element formed from conductive housing structures (e.g., internal and/or external structures, support plate structures, etc.).

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a planar housing wall. The rear housing wall may have slots that pass entirely through the rear housing wall and that therefore separate housing wall portions (and/or sidewall portions) of housing 12 from each other. The rear housing wall may include conductive portions and/or dielectric portions. If desired, the rear housing wall may include a planar metal layer covered by a thin layer or coating of dielectric such as glass, plastic, sapphire, or ceramic. Housing 12 (e.g., the rear housing wall, sidewalls, etc.) may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Display 14 may include pixels formed from light-emitting diodes (LEDs), organic LEDs (OLEDs), plasma cells, electrowetting pixels, electrophoretic pixels, liquid crystal display (LCD) components, or other suitable pixel structures. A display cover layer such as a layer of clear glass or plastic may cover the surface of display 14 or the outermost layer of display 14 may be formed from a color filter layer, thin-film transistor layer, or other display layer. Buttons such as button 24 may pass through openings in the cover layer if desired. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape with four edges, structures 16 may be implemented using peripheral housing structures that have a rectangular ring shape with four corresponding edges (as an example). Peripheral structures 16 or part of peripheral structures 16 may serve as a bezel for display 14 (e.g., a cosmetic trim that surrounds all four sides of display 14 and/or that helps hold display 14 to device 10). Peripheral structures 16 may, if desired, form sidewall structures for device 10 (e.g., by forming a metal band with vertical sidewalls, curved sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. The bottom portion of peripheral housing structures 16 may also have an enlarged lip (e.g., in the plane of the rear surface of device 10). Peripheral housing structures 16 may have substantially straight vertical sidewalls, may have sidewalls that are curved, or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface or wall. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the sides of housing 12 may be formed as flat or curved vertically extending integral metal portions of the planar metal structure. Housing structures such as these may, if desired, be machined from a block of metal and/or may include multiple metal pieces that are assembled together to form housing 12. The planar rear wall of housing 12 may have one or more, two or more, or three or more portions. Peripheral conductive housing structures 16 and/or the conductive rear wall of housing 12 may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide structures 16 from view of the user).

Display 14 may have an array of pixels that form an active area AA that displays images for a user of device 10. An inactive border region such as inactive area IA may run along one or more of the peripheral edges of active area AA.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of member 16). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 22 and 20, openings may be formed within the conductive structures of device 10 (e.g., between peripheral conductive housing structures 16 and opposing conductive ground structures such as conductive portions of housing 12, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, the ground plane that is under active area AA of display 14 and/or other metal structures in device 10 may have portions that extend into parts of the ends of device 10 (e.g., the ground may extend towards the dielectric-filled openings in regions 20 and 22), thereby narrowing the slots in regions 20 and 22.

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of these locations. The arrangement of FIG. 1 is merely illustrative.

Portions of peripheral housing structures 16 may be provided with peripheral gap structures. For example, peripheral conductive housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two of gaps 18), three peripheral conductive segments (e.g., in an arrangement with three of gaps 18), four peripheral conductive segments (e.g., in an arrangement with four of gaps 18, etc.). The segments of peripheral conductive housing structures 16 that are formed in this way may form parts of antennas in device 10.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral housing structures 16 and may form antenna slots, gaps 18, and other structures in device 10. Polymer or other dielectric may fill these grooves and other housing openings. In some situations, housing openings that form antenna slots and other structure may be filled with a dielectric such as air.

In a typical scenario, device 10 may have one or more upper antennas and one or more lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
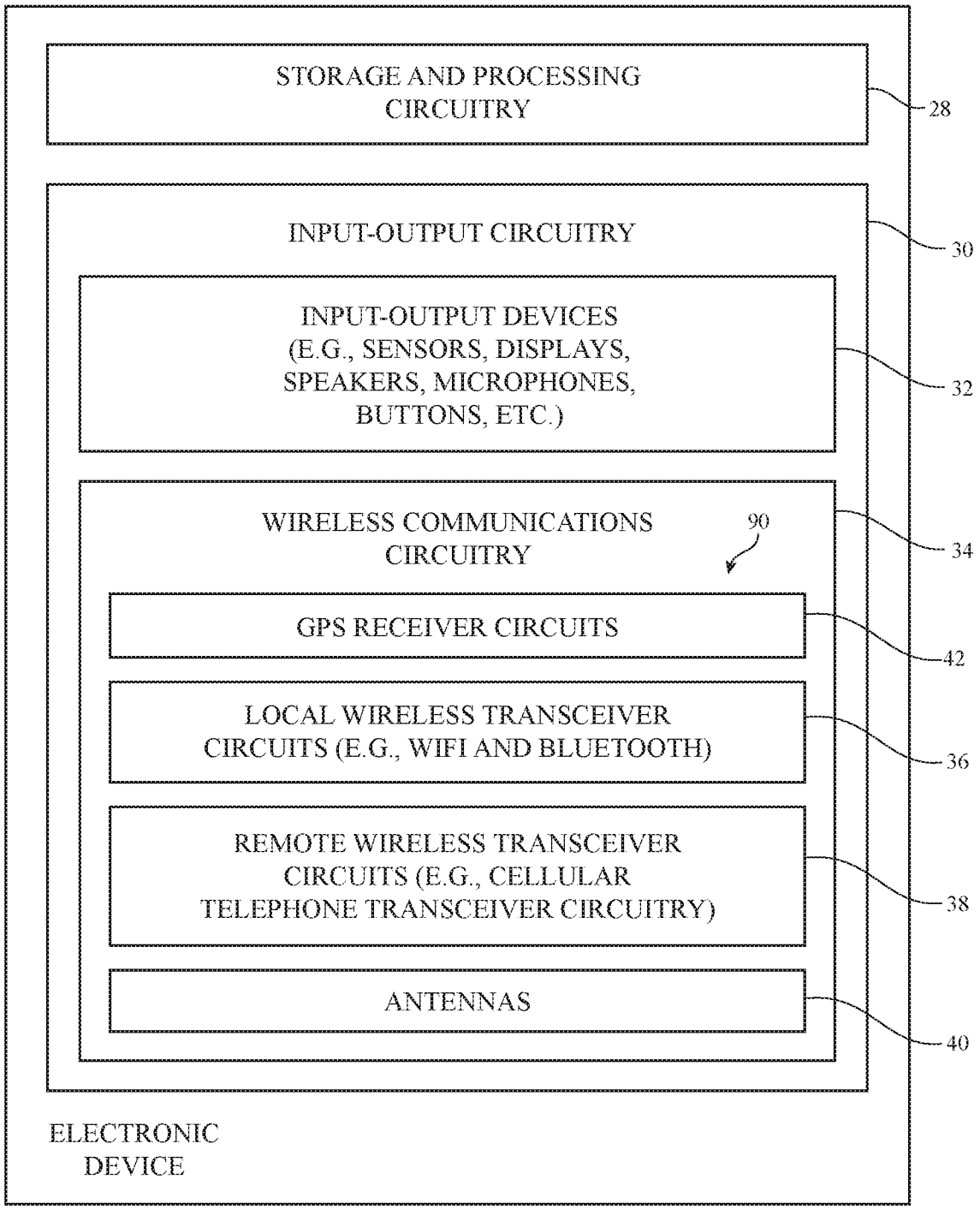
FIG. 2 is a schematic diagram of illustrative circuitry in an electronic device in accordance with an embodiment.

A schematic diagram showing illustrative components that may be used in device 10 of FIG. 1 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, multiple-input and multiple-output (MIMO) protocols, antenna diversity protocols, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, position and orientation sensors (e.g., sensors such as accelerometers, gyroscopes, and compasses), capacitance sensors, proximity sensors (e.g., capacitive proximity sensors, light-based proximity sensors, etc.), fingerprint sensors (e.g., a fingerprint sensor integrated with a button such as button 24 of FIG. 1 or a fingerprint sensor that takes the place of button 24), etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in frequency ranges such as a low communications band from 700 to 960 MHz, a low-midband from 960 to 1710 MHz, a midband from 1710 to 2170 MHz, a high band from 2300 to 2700 MHz, an ultra-high band from 3400 to 3700 MHz or other communications bands between 600 MHz and 4000 MHz or other suitable frequencies (as examples).

Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include global positioning system (GPS) receiver equipment such as GPS receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, dipole antenna structures, monopole antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
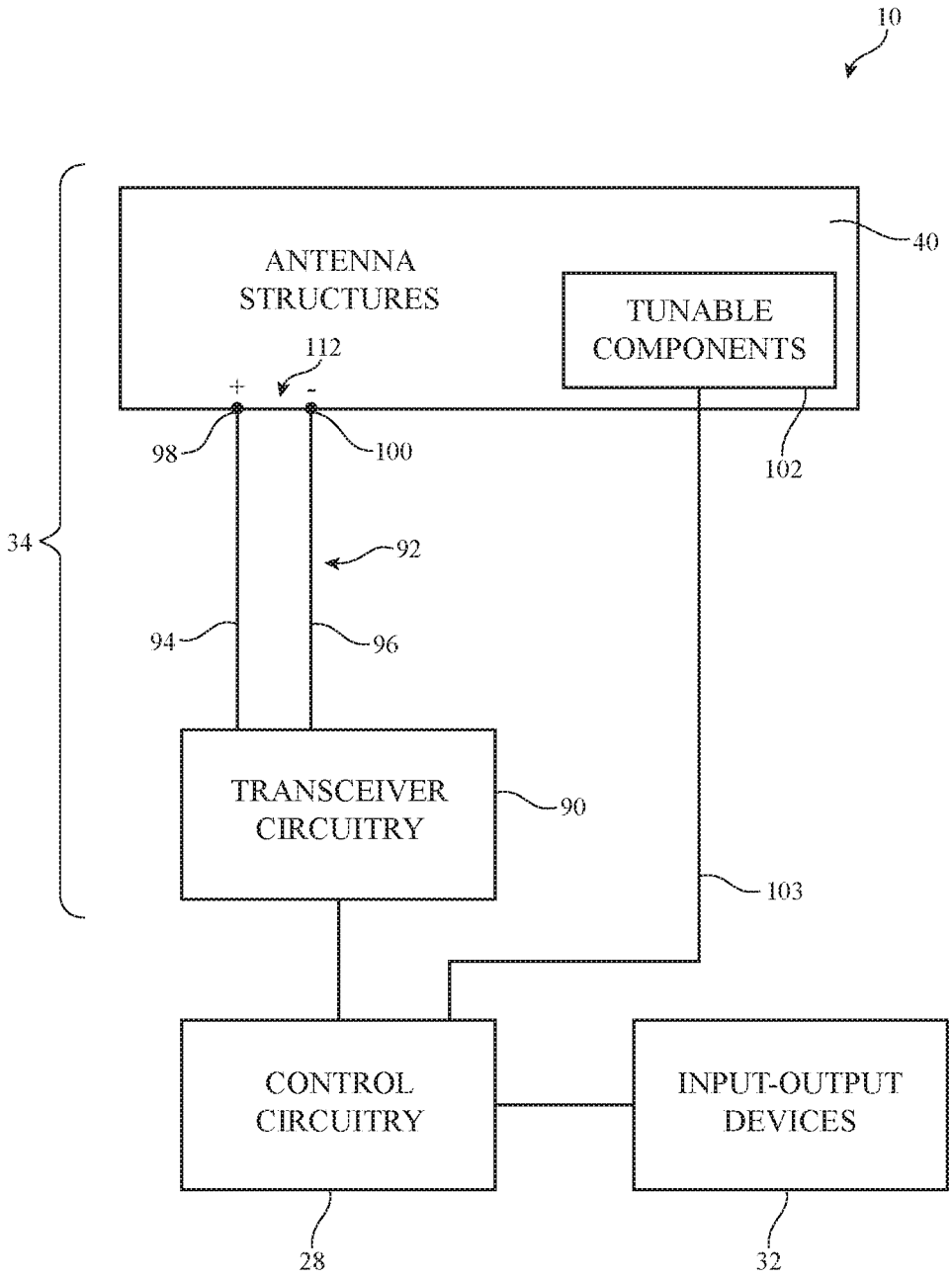
FIG. 3 is a schematic diagram of illustrative wireless circuitry in accordance with an embodiment.

As shown in FIG. 3, transceiver circuitry 90 in wireless circuitry 34 may be coupled to antenna structures 40 using paths such as path 92. Wireless circuitry 34 may be coupled to control circuitry 28. Control circuitry 28 may be coupled to input-output devices 32. Input-output devices 32 may supply output from device 10 and may receive input from sources that are external to device 10.

To provide antenna structures such as antenna(s) 40 with the ability to cover communications frequencies of interest, antenna(s) 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna(s) 40 may be provided with adjustable circuits such as tunable components 102 to tune antennas over communications bands of interest. Tunable components 102 may be part of a tunable filter or tunable impedance matching network, may be part of an antenna resonating element, may span a gap between an antenna resonating element and antenna ground, etc.

Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 28 may issue control signals on one or more paths such as path 103 that adjust inductance values, capacitance values, or other parameters associated with tunable components 102, thereby tuning antenna structures 40 to cover desired communications bands.

Path 92 may include one or more transmission lines. As an example, signal path 92 of FIG. 3 may be a transmission line having a positive signal conductor such as line 94 and a ground signal conductor such as line 96. Lines 94 and 96 may form parts of a coaxial cable, a stripline transmission line, or a microstrip transmission line (as examples). A matching network (e.g., an adjustable matching network formed using tunable components 102) may include components such as inductors, resistors, and capacitors used in matching the impedance of antenna(s) 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components.

Transmission line 92 may be coupled to antenna feed structures associated with antenna structures 40. As an example, antenna structures 40 may form an inverted-F antenna, a slot antenna, a hybrid inverted-F slot antenna or other antenna having an antenna feed 112 with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 100. Other types of antenna feed arrangements may be used if desired. For example, antenna structures 40 may be fed using multiple feeds. The illustrative feeding configuration of FIG. 3 is merely illustrative.

Control circuitry 28 may use information from a proximity sensor (see, e.g., sensors 32 of FIG. 2), wireless performance metric data such as received signal strength information, device orientation information from an orientation sensor, device motion data from an accelerometer or other motion detecting sensor, information about a usage scenario of device 10, information about whether audio is being played through speaker 26, information from one or more antenna impedance sensors, and/or other information in determining when antenna(s) 40 is being affected by the presence of nearby external objects or is otherwise in need of tuning. In response, control circuitry 28 may adjust an adjustable inductor, adjustable capacitor, switch, or other tunable component 102 to ensure that antenna structures 40 operate as desired. Adjustments to component 102 may also be made to extend the coverage of antenna structures 40 (e.g., to cover desired communications bands that extend over a range of frequencies larger than antenna structures 40 would cover without tuning).

Antennas 40 may include slot antenna structures, inverted-F antenna structures (e.g., planar and non-planar inverted-F antenna structures), loop antenna structures, combinations of these, or other antenna structures.

Figure 4:
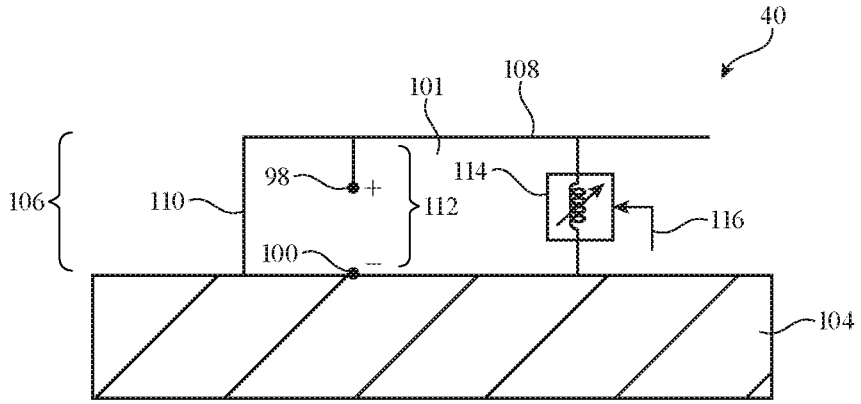
FIG. 4 is a schematic diagram of an illustrative inverted-F antenna in accordance with an embodiment.

An illustrative inverted-F antenna structure is shown in FIG. 4. As shown in FIG. 4, inverted-F antenna structure 40 (sometimes referred to herein as antenna 40 or inverted-F antenna 40) may include an inverted-F antenna resonating element such as antenna resonating element 106 and an antenna ground (ground plane) such as antenna ground 104. Antenna resonating element 106 may have a main resonating element arm such as arm 108. The length of arm 108 may be selected so that antenna structure 40 resonates at desired operating frequencies. For example, the length of arm 108 (or a branch of arm 108) may be a quarter of a wavelength at a desired operating frequency for antenna 40. Antenna structure 40 may also exhibit resonances at harmonic frequencies. If desired, slot antenna structures or other antenna structures may be incorporated into an inverted-F antenna such as antenna 40 of FIG. 4 (e.g., to enhance antenna response in one or more communications bands). As an example, a slot antenna structure may be formed between arm 108 or other portions of resonating element 106 and ground 104. In these scenarios, antenna 40 may include both slot antenna and inverted-F antenna structures and may sometimes be referred to as a hybrid inverted-F and slot antenna.

Arm 108 may be separated from ground 104 by a dielectric-filled opening such as dielectric gap 101. Antenna ground 104 may be formed from housing structures such as a conductive support plate, printed circuit traces, metal portions of electronic components, or other conductive ground structures. Gap 101 may be formed by air, plastic, and/or other dielectric materials.

Main resonating element arm 108 may be coupled to ground 104 by return path 110. Antenna feed 112 may include positive antenna feed terminal 98 and ground antenna feed terminal 100 and may run parallel to return path 110 between arm 108 and ground 104. If desired, inverted-F antenna structures such as illustrative antenna structure 40 of FIG. 4 may have more than one resonating arm branch (e.g., to create multiple frequency resonances to support operations in multiple communications bands) or may have other antenna structures (e.g., parasitic antenna resonating elements, tunable components to support antenna tuning, etc.). Arm 108 may have other shapes and may follow any desired path if desired (e.g., paths having curved and/or straight segments).

If desired, antenna 40 may include one or more adjustable circuits (e.g., tunable components 102 of FIG. 3) that are coupled to antenna resonating element structures 106 such as arm 108. As shown in FIG. 4, for example, tunable components 102 such as adjustable inductor 114 may be coupled between antenna resonating element arm structures in antenna 40 such as arm 108 and antenna ground 104 (i.e., adjustable inductor 114 may bridge gap 101). Adjustable inductor 114 may exhibit an inductance value that is adjusted in response to control signals 116 provided to adjustable inductor 114 from control circuitry 28.

Figure 5:
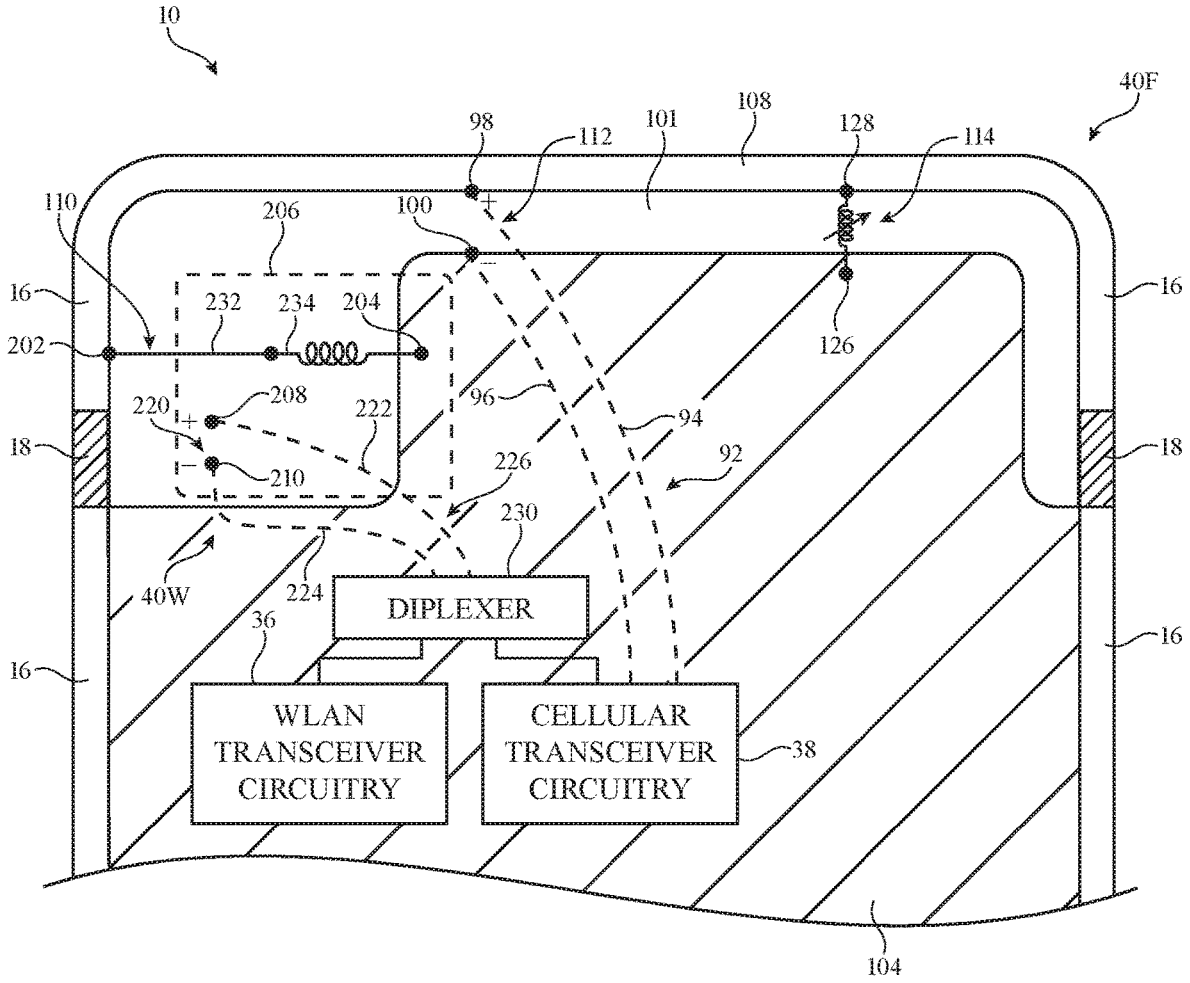
FIG. 5 is a top view of illustrative antenna structures in an electronic device in accordance with an embodiment.

A top interior view of an illustrative portion of device 10 that contains antennas 40 is shown in FIG. 5. As shown in FIG. 5, device 10 may have peripheral conductive housing structures such as peripheral conductive housing structures 16. Peripheral conductive housing structures 16 may be divided by dielectric-filled peripheral gaps (e.g., plastic gaps) such as gaps 18. Antenna structures 40 may include antenna 40F and antenna 40W. Antenna 40F (sometimes referred to as a cellular antenna) may include an inverted-F antenna resonating element arm 108 formed from a segment of peripheral conductive housing structures 16 extending between gaps 18. Air and/or other dielectrics may fill slot 101 between arm 108 and ground structures 104. If desired, opening 101 may be configured to form a slot antenna resonating element structure that contributes to the overall performance of the antenna. Antenna ground 104 may be formed from conductive housing structures, from electrical device components in device 10, from printed circuit board traces, from strips of conductor such as strips of wire and metal foil, or other conductive structures. In one suitable arrangement ground 104 is formed from conductive portions of housing 12 (e.g., portions of a rear wall of housing 12 and portions of peripheral conductive housing structures 16 that are separated from arm 108 by peripheral gaps 18).

Antenna 40F may support a resonance in one or more desired frequency bands. The length of arm 108 may be selected to resonate in one or more desired frequency bands. For example, arm 108 may support a resonance in a cellular low band LB, midband MB, and high band HB. In order to handle wireless communications at other frequencies (e.g., frequencies in the 5 GHz wireless local area network band), an additional antenna such as antenna 40W may be formed within region 206. It also may be desirable to cover the ultra-high band UHB using the antenna structures of electronic device 10. If desired, a portion of antenna 40F and a portion of antenna 40W may be used to cover communications in the ultra-high band (e.g., without the need for forming a separate antenna for covering the ultra-high band).

Ground 104 may serve as antenna ground for one or more antennas. For example, antenna 40F may include a ground plane formed from ground 104. Antenna 40W (sometimes referred to as a wireless local area network and ultra-high band antenna) may include a resonating element in region 206 and ground 104. Inverted-F antenna 40F may be fed using antenna feed 112 having a first terminal 98 coupled to peripheral housing structure 16 and a second terminal 100 coupled to ground 104 (e.g., across slot 101). Positive transmission line conductor 94 and ground transmission line conductor 96 may form transmission line 92 that is coupled between cellular transceiver circuitry 38 and antenna feed 112. Cellular transceiver circuitry 38 (i.e., remote wireless transceiver circuitry 38 as shown in FIG. 2) may handle wireless communications in frequency ranges such as a low communications band from 700 to 960 MHz, a low-midband from 960 to 1710 MHz, a midband from 1710 to 2170 MHz, a high band from 2300 to 2700 MHz, and an ultra-high band from 3400 to 3700 MHz. Cellular transceiver circuitry 38 may use transmission line 92 and feed 112 to handle low band, low-midband, midband, and/or high band communications (e.g., radio-frequency signals in the low band, low-midband, midband, and/or high band may be conveyed by antenna 40F over feed 112).

Wireless local area network and ultra-high band antenna 40W in region 206 may include an inverted-F antenna resonating element or other suitable antenna resonating element. The wireless local area network and ultra-high band antenna may convey radio-frequency signals in a wireless local area network communications band (e.g., from 5150-5850 MHz). The radio-frequency signals in the wireless local area network band may be conveyed to and from antenna 40W over a dedicated antenna feed such as feed 220. Feed 220 may include a positive antenna feed terminal 208 and ground antenna feed terminal 210. Ground antenna feed terminal 210 may be coupled to ground 104 (i.e., ground 104 may serve as an antenna ground for wireless local area network and ultra-high band antenna 40W as well as an antenna ground for antenna 40F). Positive antenna feed terminal 208 may be coupled to the antenna resonating element of wireless local area network and ultra-high band antenna 40W within region 206.

Feed 220 of the wireless local area network and ultra-high band antenna 40W may convey radio-frequency signals over positive signal conductor 222 and ground signal conductor 224 of signal path 226. Signal path 226 may be coaxial cable, a stripline transmission line, a microstrip transmission line, or other radio-frequency transmission line structure (as examples).

In order to optimize space consumption within device 10, antenna 40W may support resonances in multiple frequency bands. For example, antenna 40W may support communications in a wireless local area network band at 5 GHz (e.g., a band between approximately 5150-5850 MHz). Antenna 40W may additionally support communications in an ultra-high cellular band (e.g., at frequencies between 3400 and 3700 MHz). In order to convey radio-frequencies in the ultra-high band, feed 220 may be coupled to a port of cellular transceiver circuitry 38.

In order to isolate the signals conveyed by wireless local area network transceiver circuitry 36 from the signals conveyed by cellular telephone transceiver circuitry 38, diplexer 230 may be interposed on transmission line 226. For example, diplexer 230 may have a first port coupled to feed 220, a second port coupled to transceiver 36, and a third port coupled to transceiver 38. Diplexer 230 may receive radio-frequency signals from both wireless local area network transceiver circuitry 36 and cellular transceiver circuitry 38 and may combine the signals before conveying the combined signals to feed 220. Similarly, diplexer 230 may receive radio-frequency signals from feed 220 and may filter the signals by frequency so that the signals at wireless local area network frequencies (e.g., between 5150-5850 MHz) are conveyed to transceiver 36 and the signals at cellular telephone frequencies (e.g., in the ultra-high band) are conveyed to transceiver 38. In this way, antenna 40W may support communications over both wireless local area network and cellular telephone frequencies using the same feed 220 while isolating transceiver 36 from transceiver 38. Diplexer 230 may, for example, include one or more low-pass filters, band-pass filters, band stop filters, and/or high-pass filters. In one suitable example, wireless local area network transceiver circuitry 36 may be coupled to a high-pass filter within diplexer 230 whereas cellular transceiver 38 is coupled to a low-pass filter in diplexer 230. Other arrangements may be used if desired.

Return path 110 of inverted-F antenna 40F may be coupled between arm 108 (at node 202) and ground 104 (at node 204). Return path 110 may, for example, include a conductive element 232 and an inductive component such as inductor 234. Return path 110 (e.g., including both conductive element 232 and inductor 234) may serve as the return path for antenna 40F (e.g., cellular telephone signals that are conveyed over resonating element arm 108 of antenna 40F via feed 112 may be shorted to ground 104 over return path 110). At the same time, conductive element 232 of return path 110 may be parasitically coupled (e.g., via near field electromagnetic coupling) to conductive elements within wireless local area network and ultra-high band antenna 40W formed in region 206 (e.g., to a portion of the antenna resonating element of antenna 40W). This parasitic coupling may serve to improve the overall antenna efficiency within the ultra-high band for wireless communications circuitry 34. If desired, the antenna resonating element within region 206 of antenna 40W may be formed over a portion of slot 101 (e.g., the portion of ground 104 under region 206 may be removed) to enhance the antenna efficiency of antenna 40W relative to scenarios where ground plane 104 extends under all of region 206.

If desired, tunable components such as adjustable component 114 may bridge slot 101 at a first location along slot 101 (e.g., component 114 may be coupled between terminal 126 on ground plane 104 and terminal 128 on peripheral conductive structures 16). Component 114 may include switches coupled to fixed components such as inductors for providing adjustable amounts of inductance or an open circuit between ground 104 and peripheral conductive structures 16. Component 114 may also include fixed components that are not coupled to switches or a combination of components that are coupled to switches and components that are not coupled to switches. These examples are merely illustrative and, in general, component 114 may include other elements such as adjustable return path switches, switches coupled to capacitors, or any other desired components. If desired, adjustable component 114 may include one or more inductors coupled to a radio-frequency switching circuit. In one illustrative example, adjustable component 114 may include two inductors coupled in parallel between terminals 126 and 128. A radio-frequency switching circuit may selectively couple the inductors between terminals 126 and 128 to tune the antenna. Additional adjustable components may be included at any desired location within electronic device 10 (i.e., between resonating element 108 and ground 104, across gap 18, etc.) to tune antenna 40F. The example of FIG. 5 is merely illustrative.

Figure 6:
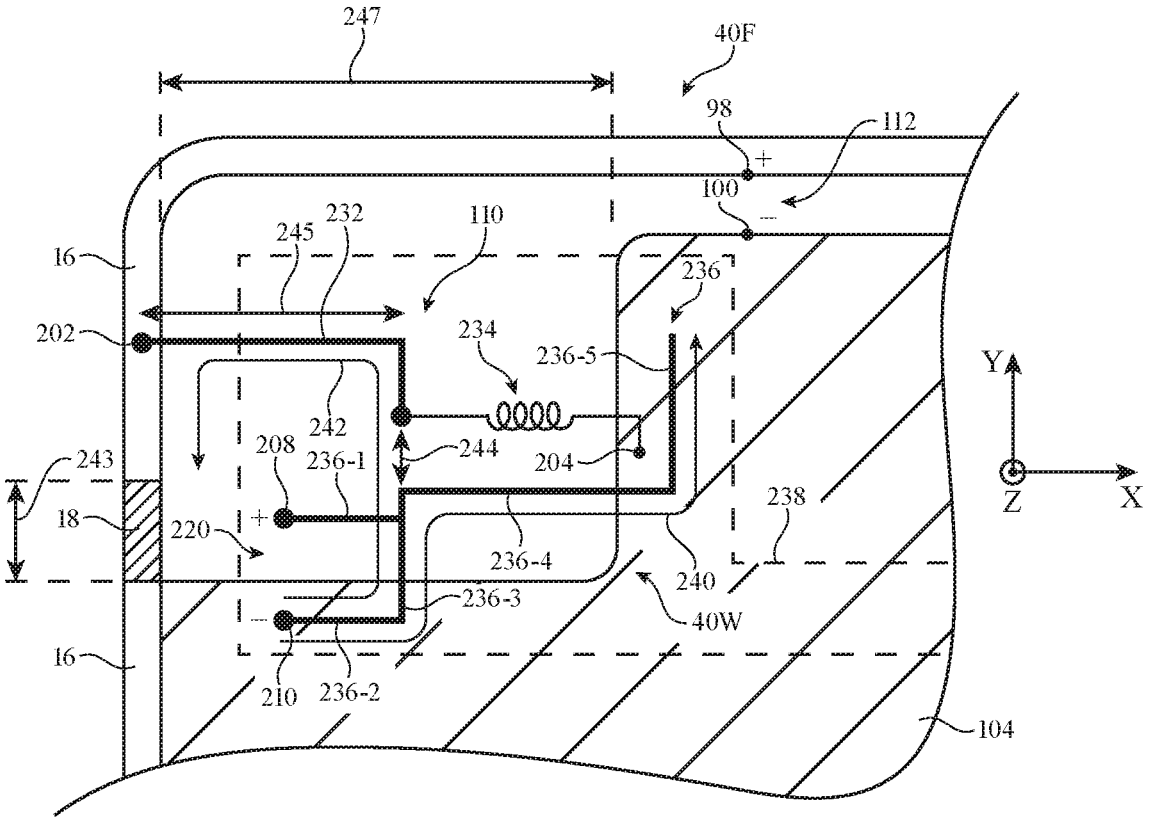
FIG. 6 is a top view of an illustrative wireless local area network and ultra-high band antenna in accordance with an embodiment.

FIG. 6 is a top view of wireless local area network and ultra-high band antenna 40W (e.g., within region 206 of FIG. 5). As shown in FIG. 6, antenna 40W may include an antenna resonating element such as antenna resonating element 236 and ground 104. Antenna resonating element 236 may, for example, include conductive traces on one or more dielectric substrates. A first portion 236-1 of resonating element 236 may be coupled to positive antenna feed terminal 208. A second portion 236-2 of resonating element 236 may be coupled to ground antenna feed terminal 210. The first and second portions of resonating element 236 may be coupled to a third portion 236-3 of resonating element 236 that is substantially perpendicular to the first and second portions. The third portion of resonating element 236 may be coupled to a fourth portion 236-4 of resonating element 236 that is substantially perpendicular to the third portion and substantially parallel to the first and second portions. Fourth portion 236-4 of resonating element 236 may be coupled to a fifth portion 236-5 of resonating element 236 that is substantially perpendicular to the fourth portion and substantially parallel to the third portion. In the example of FIG. 6, antenna 40W is an inverted-F antenna structure (with a return path formed by segment 236-2 and a portion of segment 236-3). This example for the arrangement of resonating element 236 is merely illustrative, and other arrangements for resonating element 236 may be used if desired. The segments of resonating element 236 may follow any desired paths and have any desired shapes.

The metal traces that form antenna resonating element 236 may be formed on any desired substrate. In some cases, antenna resonating element 236 may be formed from traces on a dielectric support structure such as a plastic carrier. The plastic carrier may be formed on an underlying printed circuit such as printed circuit 238. Printed circuit 238 may be a rigid printed circuit board (e.g., a printed circuit board formed from fiberglass-filled epoxy or other rigid printed circuit board material) or may be a flexible printed circuit (e.g., a flexible printed circuit formed from a sheet of polyimide or other flexible polymer layer).

The length of portions 236-1, 236-2, 236-3, 236-4, and 236-5 of antenna resonating element 236 may be selected so that the antenna resonating element resonates at desired frequencies. For example, the sum of the lengths of portions 236-3, 236-4, and 236-5 may be selected to be approximately equal to one quarter of a wavelength of operation of antenna 40W (e.g., a wavelength corresponding to a wireless local area network frequency between 5150 and 5850 MHz). Antenna feed 220 may convey radio-frequency wireless local area network signals in a wireless local area network band such as a band between 5150 and 5850 MHz (e.g., using transceiver 36). Antenna currents 240 corresponding to the wireless local area network signals at these frequencies may flow over antenna resonating element 236 (e.g., the length of the different portions of resonating element 236 may be selected to support resonance at these frequencies). Ultra-high band signals may also flow over feed 220 (e.g., via transceiver 38 and transmission line 226). In the ultra-high band (e.g., 3400-3700 MHz), antenna resonating element 236 may be parasitically coupled to conductive element 232 of return path 110 of antenna 40F. Corresponding ultra-high band antenna currents 242 may be present on antenna resonating element 236, conductive element 232, and peripheral conductive housing structure 16.

As previously discussed, for antenna 40F, conductive element 232 and inductor 234 serve as a return path between terminal 202 on peripheral conductive structure 16 and terminal 204 on ground 104. However, when ultra-high band signals are conveyed to feed 220, antenna currents 242 are induced on conductive element 232 (sometimes referred to as a parasitic element) via near field electromagnetic coupling and continue to flow along the corresponding path 242. In this way, path 242 supports a resonance in the ultra-high band (i.e., antenna currents flow over antenna resonating element 236, conductive element 232, and peripheral conductive housing structure 16 at the ultra-high band frequencies). The length of the antenna resonating element 236, conductive element 232, and peripheral conductive housing structure 16 that form path 242 may be selected to support this resonance (e.g., the sum of the lengths of antenna resonating element 236, conductive element 232, and peripheral conductive housing structure 16 that form path 242 may be selected to be approximately equal to one quarter of a wavelength of the ultra-high band signals). Because conductive element 232 carries induced ultra-high band antenna currents from feed 220 (despite not being directly fed by feed 220), conductive element 232 may sometimes be referred to as an indirectly-fed antenna element (at least at ultra-high band frequencies).

Conductive element 232 may be separated from antenna resonating element 236 by a distance 244 (e.g., in the direction of the Y-axis of FIG. 6). Gap 18 may have a width 243. Conductive element 232 may have a portion with a length 245. As previously discussed, at least a portion of ground plane 104 may be removed to help improve performance of the wireless local area network and ultra-high band antenna. The removed portion of ground plane 104 may sometimes be referred to as a cutout. The cutout may have a width 247. Width 243 may be between 1 and 3 millimeters, between 1 and 5 millimeters, greater than 0.5 millimeters, greater than 1 millimeter, less than 4 millimeters, or any other desired width. Distance 244 may be between 0.5 and 3 millimeters, less than 2 millimeters, greater than 0.5 millimeters, or any other desired distance. Length 245 may be between 2 and 8 millimeters, between 4 and 6 millimeters, between 5 and 6 millimeters, greater than 3 millimeters, less than 10 millimeters, or any other desired length. Width 247 may be between 2 and 15 millimeters, between 8 and 12 millimeters, between 5 and 15 millimeters, greater than 2 millimeters, greater than 5 millimeters, greater than 8 millimeters, less than 10 millimeters, less than 15 millimeters, or any other desired width. Widths 243 and 247, distance 244, and length 245 may be adjusted to improve the antenna performance (antenna efficiency) and ensure the antenna resonates in desired frequency bands.

Conductive element 232 may be formed from metal traces on a dielectric substrate (i.e., on the same dielectric substrate as antenna resonating element 236 or on a different dielectric substrate as antenna resonating element 236), one or more additional conductive structures (i.e., clips, springs, brackets, pins, screws, etc.), or a combination of metal traces and additional conductive structures.

Figure 7:
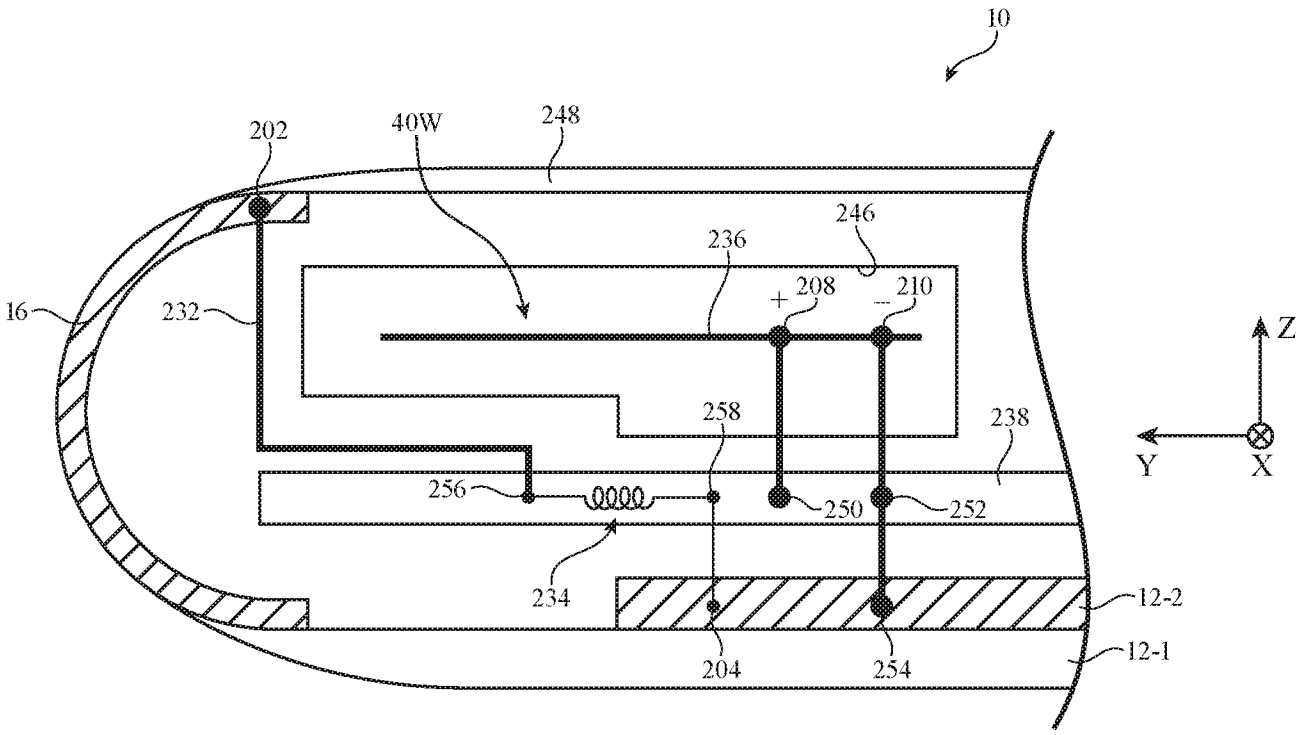
FIG. 7 is a cross-sectional side view of a wireless local area network and ultra-high band antenna of the type shown in FIG. 6 in accordance with an embodiment.

FIG. 7 is a cross-sectional side view of wireless local area network and ultra-high band antenna 40W (e.g., as taken in the Y-Z plane of FIG. 6). As shown in FIG. 7, antenna resonating element 236 may be formed on a dielectric support structure such as carrier 246. Carrier 246 may be formed from molded plastic or other dielectric materials. In one suitable arrangement, carrier 246 may be formed from plastic and may sometimes be referred to herein as plastic carrier 246. Portions of carrier 246 may form a dielectric block that serves as a riser for resonating element 236. Carrier 246 may raise antenna resonating element 236 upwards away from underlying conductive structures such as ground 104, thereby enhancing antenna bandwidth. Metal traces on carrier 246 such as the metal traces that form antenna resonating element 236 may be formed from laser patterned metal (e.g., metal plated onto carrier 246 following selective laser activation of desired antenna trace areas by laser exposure using laser direct structuring techniques), may be formed from metal foil that has been incorporated into carrier 246 using insert molding techniques, and/or may include other metal structures embedded within or formed on surfaces of carrier 246.

Carrier 246 may be formed on printed circuit 238. As previously discussed, printed circuit 238 may be a rigid printed circuit board (e.g., a printed circuit board formed from fiberglass-filled epoxy or other rigid printed circuit board material) or may be a flexible printed circuit (e.g., a flexible printed circuit formed from a sheet of polyimide or other flexible polymer layer). Printed circuit 238 may, for example, form a main logic board or motherboard for electronic device 10.

As shown in FIG. 7, housing 12 may include dielectric housing portions such as dielectric layer 12-1 and conductive housing portions such as conductive layer 12-2 (sometimes referred to herein as conductive housing wall 12-2). If desired, dielectric layer 12-1 may by formed under layer 12-2 such that layer 12-1 forms an exterior surface of device 10 (e.g., thereby protecting layer 12-2 from wear and/or hiding layer 12-2 from view of a user). Carrier 246 and printed circuit 238 may be formed over conductive housing portion 12-2 and dielectric housing portion 12-1. Conductive housing portion 12-2 may form a portion of ground 104. As examples, conductive housing portion 12-2 may be a conductive support plate or wall (e.g., a conductive back plate or rear housing wall) for device 10. Conductive housing portion 12-2 may, if desired, extend across the width of device 10 (e.g., between two opposing sidewalls formed by peripheral housing structures 16). If desired, conductive housing portion 12-2 and the opposing sidewalls of device 10 may be formed from a single integral piece of metal or portion 12-2 may otherwise be shorted to the opposing sidewalls of device 10. Dielectric layer 12-1 may be a thin glass, sapphire, ceramic, or sapphire layer or other dielectric coating, as examples. In another suitable arrangement, layer 12-1 may be omitted if desired.

Display cover layer 248 may cover carrier 246 and printed circuit 238. Display cover layer 248 may be a layer of clear glass or plastic that covers the surface of an underlying display module for display 14 of FIG. 1. Alternatively, display cover layer 248 may be the outermost layer of the display module (i.e., layer 248 may be a color filter layer, thin-film transistor layer, or other display layer).

As shown in FIG. 7, positive antenna feed terminal 208 of antenna 40W may be coupled to an additional terminal 250 on printed circuit 238. Terminals 208 and 250 may be electrically connected using any desired conductive interconnect structures (e.g., springs, screws, clips, brackets, pins, conductive vias, solder, welds, conductive adhesive, etc.). Ground antenna feed terminal 210 may be coupled to terminal 252 on printed circuit 238. Terminal 252 in printed circuit 238 may be coupled to terminal 254 on ground 104 (e.g., on conductive layer 12-2). Terminals 210, 252, and 254 may be electrically connected by one or more conductive structures (e.g., springs, screws, clips, brackets, pins, conductive vias, solder, welds, conductive adhesive, etc.). In one suitable arrangement, a first screw may be used to couple terminal 208 to terminal 250 and a second screw may be used to couple terminal 210 to both terminals 252, and 254. Printed circuit 238 and carrier 246 may include one or more openings (e.g., threaded holes) or other engagement structures to accommodate screws or other fasteners. Fasteners used to form conductive paths between carrier 246, printed circuit 238, and conductive layer 12-2 may, for example, be used to mechanically secure carrier 246, printed circuit 238, and layer 12-2 together. Printed circuit 238 may include transmission line structures for conveying radio-frequency signals between feed terminals 208 and 210 and transceivers 36 and 38 (e.g., structures for transmission line 92 and/or 226 of FIG. 5).

Conductive element 232 may be coupled between terminal 202 on peripheral conductive housing structure 16 and terminal 256 in printed circuit 238. Inductor 234 may be coupled between terminals 256 and 258 (e.g., inductor 234 may be mounted to printed circuit 238). Terminal 258 in printed circuit 238 may be coupled to ground terminal 204 on ground 104 (e.g., layer 12-2). Conductive element 232 may be implemented using any desired conductive structures to short terminal 202 to terminal 256. For example, conductive element 232 may include a shorting pin, metal strip, an integral portion of housing 16, conductive wire, a conductive screw, a conductive spring, or other structures. If desired, a portion of conductive element 232 may be formed from conductive traces on printed circuit 238. Inductor 234 may be a fixed component on printed circuit 238 (e.g., a surface-mount technology component) or may be formed from a distributed inductance on printed circuit 238. A conductive interconnect structure may electrically connect terminal to 258 to terminal 204. For example, a screw or other fastener may be used to electrically connect terminals 258 and 204.

Figure 8:
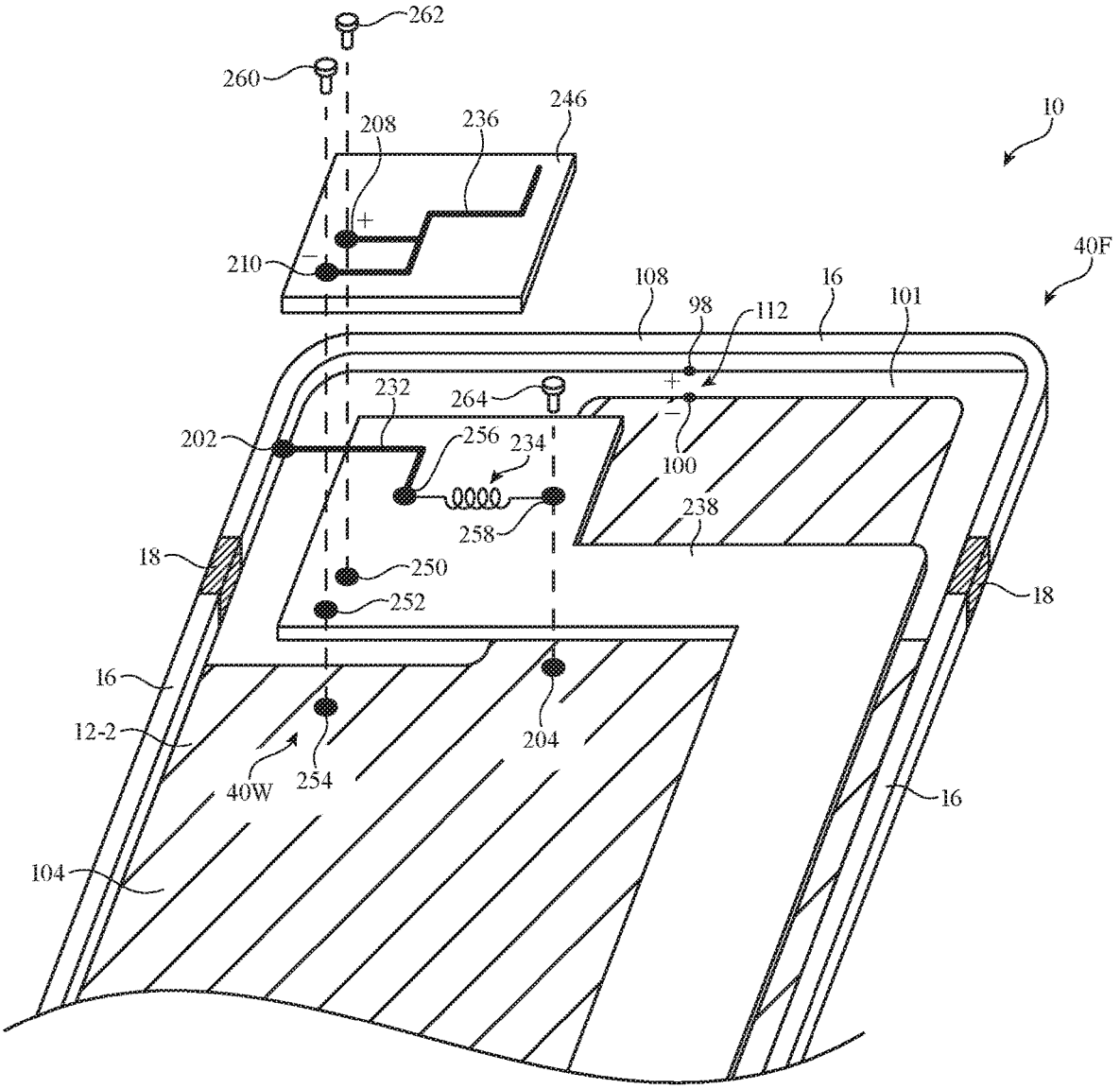
FIG. 8 is a top perspective view of an illustrative electronic device with a carrier on which antenna structures of the type shown in FIGS. 6 and 7 have been formed in accordance with an embodiment.

FIG. 8 is an interior top perspective view of electronic device 10. As shown in FIG. 8, conductive housing wall 12-2 may form antenna ground 104 and may extend between opposing sides of peripheral conductive structures 16. Opening 101 may separate arm 108 of antenna 40F from ground 104. Antenna feed 112 for antenna 40F may include positive antenna feed terminal 98 and ground antenna feed terminal 100 coupled to opposing sides of opening 101. Antenna structures for antenna 40W such as the metal traces of antenna resonating element 236 may be formed on carrier 246.

Conductive fasteners such as screws 260, 262, and 264 may be used to mount carrier 246 and printed circuit 238 within the housing of device 10 and may be used to carry antenna signals.

For example, screw 260 may form an electrical contact between terminal 210 of resonating element 236, terminal 252 on printed circuit 238, and terminal 254 on ground 104. Screw 260 may pass through an opening in carrier 246 (at terminal 210) and an opening in printed circuit 238 (at terminal 252) and may screw into a threaded opening in ground 104 (at terminal 254). Screw 260 may serve to short ground antenna feed terminal 210 to ground 104 and to transmission line structures in printed circuit 238.

Screw 262 may form an electrical contact between terminal 208 of resonating element 236 and terminal 250 on printed circuit 238. Screw 262 may pass through an opening in carrier 246 (at terminal 208) and may screw into a threaded opening in printed circuit 238 (at terminal 250). Screw 262 may serve to couple feed terminal 208 to transmission line structures on printed circuit 238.

Screw 264 may form an electrical contact between terminal 258 on printed circuit 238 and terminal 204 on ground 104. Screw 264 may pass through an opening in printed circuit 238 (at terminal 258) and may screw into a threaded opening in ground 104 (at terminal 204). Screw 264 may serve to short antenna signals conveyed by antenna feed 112 to ground 104 through structure 232 and inductor 234.

The example of FIG. 8 is merely illustrative. In general, any desired conductive interconnect structures may be used to electrically connect terminals within electronic device 10. In the example of FIG. 8, plastic carrier 246 is used to support an antenna resonating element that is used to convey both wireless local area network and ultra-high band signals. If desired, plastic carrier 246 may carry antenna traces for a single antenna, may carry antenna traces for two different antennas, may carry antenna traces for two or more different antennas, may carry antenna traces for three or more different antennas, etc.

In the example of FIGS. 7 and 8, antenna resonating element 236 is formed on carrier 246 and conductive element 232 is not formed on carrier 246. However, this is merely illustrative. If desired, carrier 246 may carry antenna resonating element 236 and metal traces that form at least a portion of conductive element 232.

Figure 9:
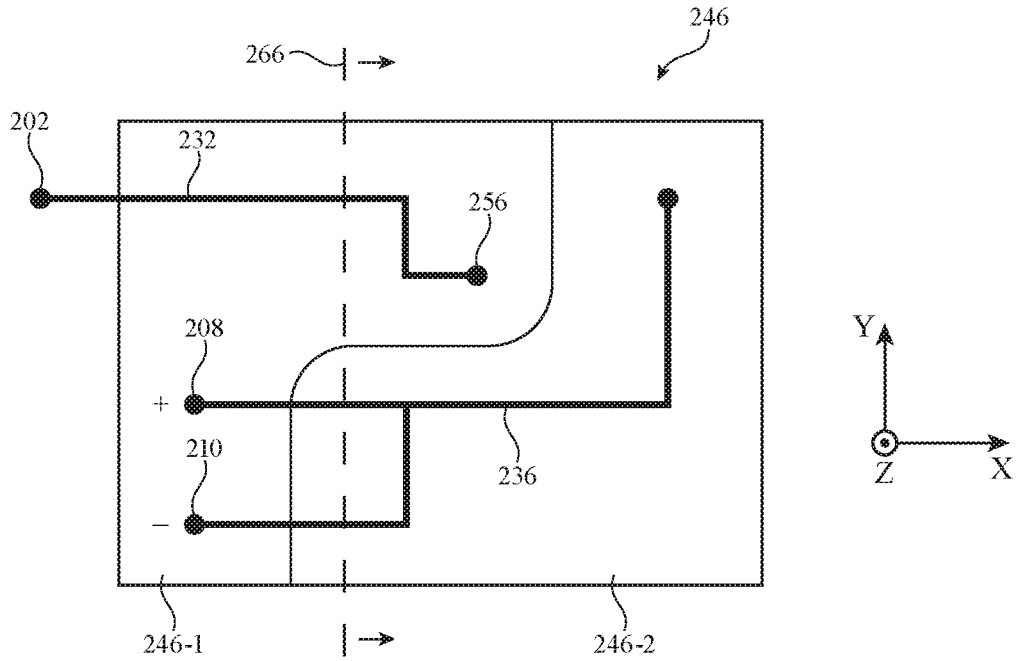
FIG. 9 is a top view of an illustrative carrier for a wireless local area network and ultra-high band antenna in accordance with an embodiment.

FIG. 9 is a top view of an illustrative carrier with both metal traces for antenna resonating element 236 and metal traces that form at least a portion of conductive element 232. As shown in FIG. 9, carrier 246 may have a first portion 246-1 with a first height and a second portion 246-2 with a second height that is greater than the first height (e.g., in the Z-dimension of FIG. 9). Antenna resonating element 236 may be coupled to positive antenna feed terminal 208 and ground antenna feed terminal 210. Conductive element 232 may be coupled between terminals 202 and 256.

Figure 10:
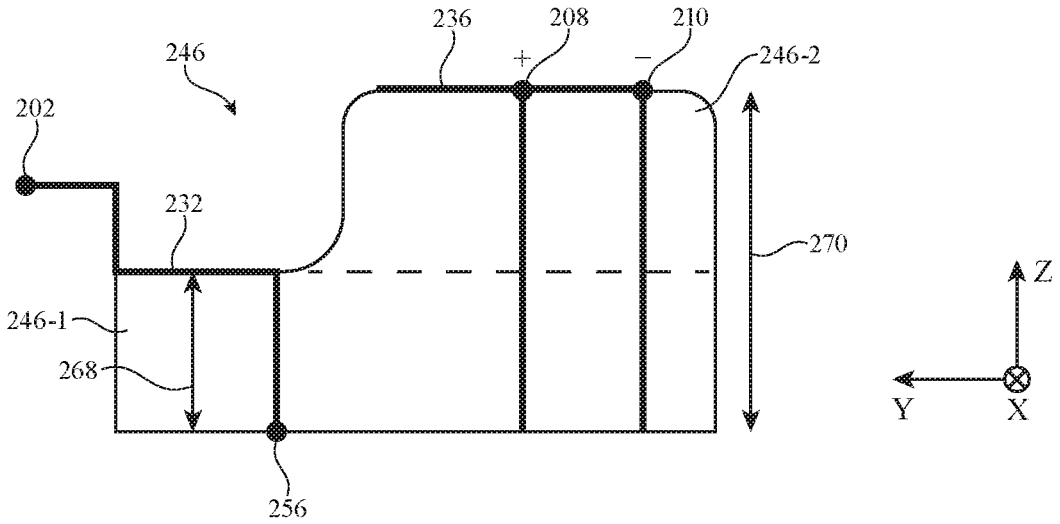
FIG. 10 is a cross-sectional side view of an illustrative carrier of the type shown in FIG. 9 in accordance with an embodiment.

FIG. 10 is cross-sectional side view taken along line 266 of FIG. 9. As shown in FIG. 10, carrier portion 246-1 has a first height 268 whereas carrier portion 246-2 has a second height 270. Height 270 may be greater than height 268. Conductive element 232 may be formed at least partially from metal traces on portion 246-1 of carrier 246. Metal traces on portion 246-1 of carrier may be coupled to additional conductive structures (e.g., springs, screws, clips, brackets, pins, conductive vias, solder, welds, conductive adhesive, etc.) that form additional portions of conductive element 232. Antenna resonating element 236 may be formed on carrier portion 246-2. The example of FIGS. 9 and 10 are merely illustrative. If desired, height 270 may be less than height 268. Traces 232 and/or 236 may be embedded within the material of carrier 246 if desired.

Figure 11A:
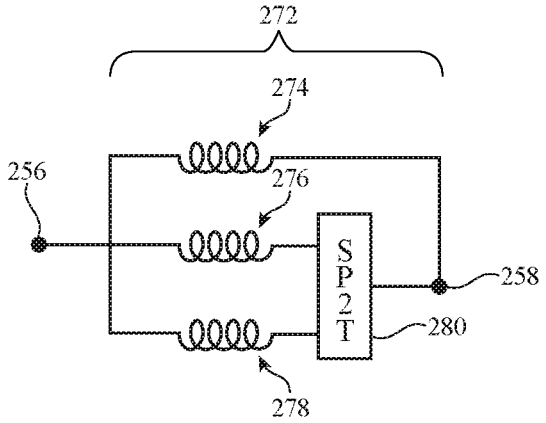
FIGS. 11A-11C are circuit diagrams of illustrative adjustable components that may be formed in a return path of antenna structures of the type shown in FIGS. 5-8 in accordance with an embodiment.
Figure 11B:
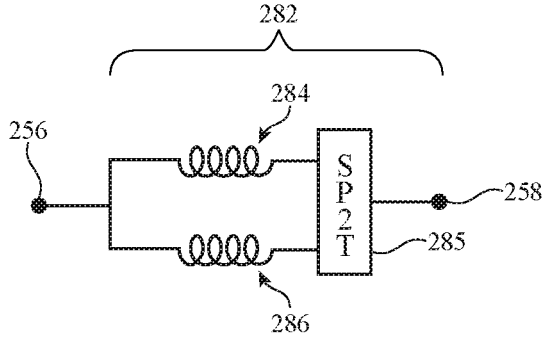
Figure 11C:
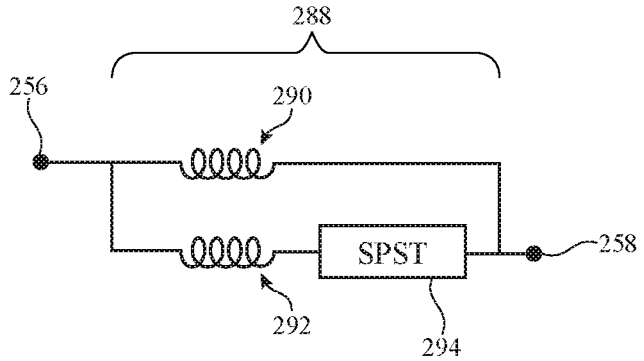

In the example of FIGS. 6-8, inductor 234 is depicted as a single fixed inductor. However, this is merely illustrative. FIGS. 11A-11C are circuit diagrams showing other possible arrangements for implementing return path 110 of antenna 40F.

As shown in FIG. 11A, adjustable component 272 may be interposed between terminals 256 and 258 (e.g., within return path 110 of antenna 40F). Adjustable component 272 may include multiple inductors such as inductors 274, 276, and 278. Inductors 276 and 278 may be coupled to radio-frequency switching circuit 280. Switching circuit 280 may be a single-pole double-throw switch, for example. When switch 280 is in a first state, inductor 276 may be coupled between terminals 256 and 258. When switch 280 is in a second state, inductor 278 may be coupled between terminals 256 and 258. In a third state, switch 280 may be open and neither inductor 276 nor inductor 278 is coupled between terminals 256 and 258. The state of switch 280 may be changed to tune antenna 40F to resonate in particular frequencies. Inductor 274 may be a fixed inductor that is not coupled to switch 280. Inductor 274 may be referred to as a bypass inductor. Inductor 274 may always be coupled between terminals 256 and 258. Inductors 274, 276, and 278 may have any desired inductance values. The inductance values of inductors 274, 276, and 278 may be different or may be the same.

In the example of FIG. 11B, adjustable component 282 may be interposed between terminals 256 and 258. Adjustable component 282 may include inductors 284 and 286. Inductors 284 and 286 may be coupled to radio-frequency switching circuit 285. Switching circuit 285 may be a single-pole double-throw switch, for example. When switch 285 is in a first state, inductor 284 may be coupled between terminals 256 and 258. When switch 285 is in a second state, inductor 286 may be coupled between terminals 256 and 258. The state of switch 285 may be changed to tune antenna 40F to resonate in particular frequencies. Inductors 284 and 286 may have any desired inductance values. The inductance values of inductors 284 and 286 may be different or may be the same.

In the example of FIG. 11C, adjustable component 288 may be interposed between terminals 256 and 258. Adjustable component 288 may include inductors 290 and 292. Inductors 290 and 292 may be coupled to radio-frequency switching circuit 294. Switching circuit 294 may be a single-pole single-throw switch, for example. When switch 294 is in a first state, inductor 292 may be coupled between terminals 256 and 258. When switch 294 is in a second state, switch 294 may be open and inductor 292 is not coupled between terminals 256 and 258. The state of switch 294 may be changed to tune antenna 40F to resonate in particular frequencies. Inductor 290 may be a fixed inductor that is not coupled to switch 294. Inductor 290 may be referred to as a bypass inductor. Inductor 290 may always be coupled between terminals 256 and 258. Inductors 290 and 292 may have any desired inductance values. The inductance values of inductors 290 and 292 may be different or may be the same.

The examples of FIGS. 11A-11C are merely illustrative. In general, any desired components may be connected between terminals 256 and 258 in the return path (i.e., inductors, capacitors, resistors, etc.) of antenna 40F.

Figure 12:
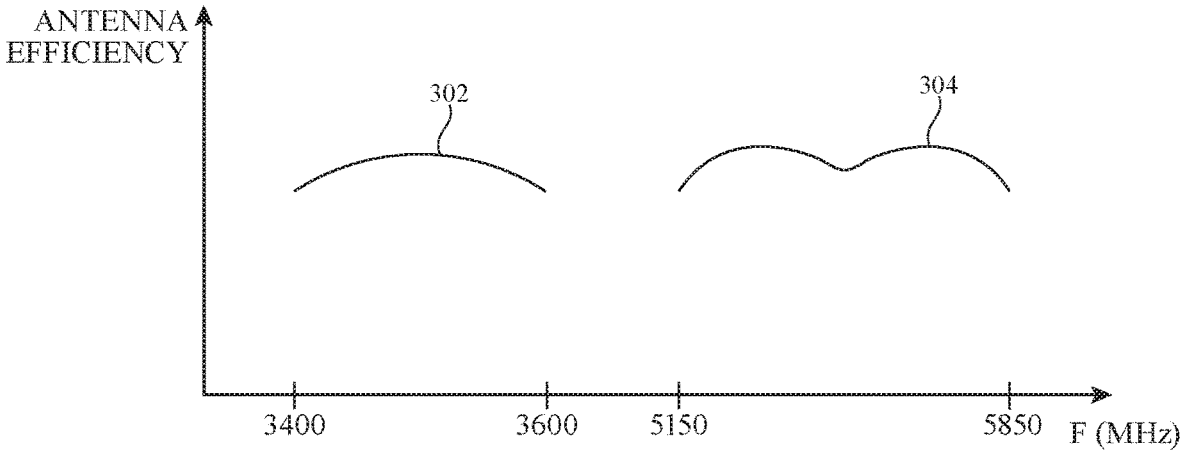
FIG. 12 is a graph of antenna performance (antenna efficiency) as a function of frequency for a wireless local area network and ultra-high band antenna of the type shown in FIGS. 5-10 in accordance with an embodiment.

FIG. 12 is a graph of antenna efficiency as a function of frequency for an illustrative wireless local area network and ultra-high band antenna of the type shown in FIGS. 6-10. As shown in FIG. 12, antenna 40W may exhibit resonances in an ultra-high band UHB (e.g., 3400-3600 MHz) and a 5 GHz wireless local area network band (e.g., 5150-5850 MHz). This example is merely illustrative and, if desired, antenna 40 may exhibit resonances in a subset of these bands and/or in additional bands.

Ultra-high band (UHB) may extend from 3400 MHz to 3600 MHz or other suitable frequency range. As shown in FIG. 12, antenna 40W may have an antenna efficiency characterized by curve 302 in ultra-high band UHB. The response of antenna 40W may be associated with antenna currents flowing over path 242 of FIG. 6, for example. The 5 GHz wireless local area network band may extend from 5150 to 5850 MHz or other suitable frequency range. As shown in FIG. 12, antenna 40W may have an antenna efficiency characterized by curve 304 in the 5 GHz wireless local area network band. The response of antenna 40W may be associated with antenna currents flowing over path 240 of FIG. 6, for example. In this way, antennas 40W and 40F may collectively cover multiple cellular telephone bands such as a low band, midband, high band, and ultra-high band, as well as a wireless local area network band with satisfactory antenna efficiency and without requiring the use of a separate antenna within device 10 for handling the ultra-high band. This may, for example, optimize the space required within device 10 to form the antenna structures required for covering each of these bands.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

an antenna ground;

a first antenna that includes the antenna ground, a first antenna resonating element arm, a first antenna feed having a first positive antenna feed terminal coupled to the first antenna resonating element arm and a first ground antenna feed terminal coupled to the antenna ground, and a return path coupled between the first antenna resonating element arm and the antenna ground, wherein the first antenna is configured to convey radio-frequency signals in a first frequency band; and a second antenna that includes the antenna ground, a second antenna resonating element arm, and a second antenna feed having a second positive antenna feed terminal coupled to the second antenna resonating element arm and a second ground antenna feed terminal coupled to the antenna ground, wherein the second antenna is configured to convey radio-frequency signals in a second frequency band that is different from the first frequency band and the second antenna resonating element arm is parasitically coupled to the return path of the first antenna at frequencies in a third frequency band that is different from the first and second frequency bands.

2. The electronic device defined in claim 1, wherein the third frequency band is higher than the first frequency band and lower than the second frequency band.

3. The electronic device defined in claim 2, wherein the second frequency band comprises frequencies between 5150 MHz and 5850 MHz and the third frequency band comprises frequencies between 3400 MHz and 3700 MHz.

4. The electronic device defined in claim 1, further comprising:

a housing having peripheral conductive housing structures, wherein a segment of the peripheral conductive housing structure forms the first antenna resonating element arm.

5. The electronic device defined in claim 4, further comprising:

a third antenna resonating element arm formed from an additional segment of the peripheral conductive housing structures, wherein the segment of the peripheral conductive housing structures and the additional segment of the peripheral conductive housing structures extend from opposing sides of the first positive antenna feed terminal.

6. The electronic device defined in claim 5, wherein the first antenna feed is configured to convey radio-frequency signals in the first frequency band and the second antenna feed is configured to convey radio-frequency signals in the second and third frequency bands.

7. The electronic device defined in claim 5, wherein the return path of the first antenna comprises a conductive structure and an adjustable circuit coupled between the first antenna resonating element arm and the antenna ground.

8. The electronic device defined in claim 7, wherein the adjustable circuit comprises first and second inductors coupled in parallel between the conductive structure and a switch that selectively couples either the first inductor or the second inductor to the antenna ground.

9. The electronic device defined in claim 8, wherein the adjustable circuit further comprises a third inductor that is coupled between the conductive structure and the antenna ground in parallel with the first inductor, the second inductor, and the switch.

10. The electronic device defined in claim 7, wherein the adjustable circuit comprises a first inductor coupled between the conductive structure and a switch that selectively couples the first inductor to the antenna ground and the adjustable circuit further comprises a second inductor coupled between the conductive structure and the antenna ground in parallel with the first inductor and the switch.

11. The electronic device defined in claim 4, wherein the second antenna resonating element arm comprises metal traces on a plastic carrier.

12. An electronic device, comprising:

a housing having a peripheral conductive structure;

an antenna ground;

a conductive path coupled between the peripheral conductive structure and the antenna ground; and metal traces on a substrate, wherein the peripheral conductive structure is configured to convey wireless signals in a first radio-frequency communications band, the metal traces are configured to convey wireless signals in a second radio-frequency communications band, and a portion of the peripheral conductive structure, the conductive path, and a portion of the metal traces are configured to convey wireless signals in a third radio-frequency communications band.

13. The electronic device defined in claim 12, wherein the metal traces are parasitically coupled to the conductive path at frequencies in the third radio-frequency communications band.

14. The electronic device defined in claim 12, wherein the substrate comprises a plastic carrier and a portion of the conductive path is formed on the plastic carrier.

15. The electronic device defined in claim 12, wherein the substrate comprises a plastic carrier, the electronic device further comprising:

at least one fastener that carries antenna signals and that mounts the plastic carrier to a printed circuit.

16. The electronic device defined in claim 12, wherein the conductive path comprises a conductive structure that is coupled to the peripheral conductive structure and an adjustable circuit that is coupled between the conductive structure and the antenna ground.

17. The electronic device defined in claim 12, further comprising:

a first antenna feed having a first positive antenna feed terminal coupled to the peripheral conductive structure; and a second antenna feed having a second positive antenna feed terminal coupled to the metal traces.

18. An electronic device, comprising:

a housing having peripheral conductive housing structures;

a first antenna resonating element formed from a segment of the peripheral conductive housing structures and configured to resonate in a first frequency band;

an antenna ground;

a first antenna feed having a first positive antenna feed terminal coupled to the first antenna resonating element and a first ground antenna feed terminal coupled to the antenna ground;

a return path coupled between the first antenna resonating element and the antenna ground;

a second antenna resonating element; and a second antenna feed having a second positive antenna feed terminal coupled to the second antenna resonating element and a second ground antenna feed terminal coupled to the antenna ground, wherein the second antenna resonating element is configured to resonate in a second frequency band that is higher than the first frequency band, and wherein a portion of the second antenna resonating element, at least a portion of the return path, and at least a portion of the first antenna resonating element are configured to resonate in a third frequency band that is higher than the first frequency band and lower than the second frequency band.

19. The electronic device defined in claim 18, wherein the second antenna resonating element arm is parasitically coupled to the return path at frequencies in the third frequency band.

20. The electronic device defined in claim 19, wherein the first frequency band comprises frequencies between 960 MHz and 1710 MHz, the second frequency band comprises frequencies between 5150 MHz and 5850 MHz, and the third frequency band comprises frequencies between 3400 MHz and 3700 MHz.

* * * * *